US006733429B2

(12) United States Patent
Nizamuddin

(10) Patent No.: US 6,733,429 B2
(45) Date of Patent: May 11, 2004

(54) MULTI-MODE EXERCISER

(76) Inventor: Nash Nizamuddin, 30 Normark Drive, Thornhill, Ontario (CA), L3T 3R1

( * ) Notice: Subject to any disclaimer, the term of this patent is extended or adjusted under 35 U.S.C. 154(b) by 0 days.

(21) Appl. No.: 10/222,300

(22) Filed: Aug. 16, 2002

(65) Prior Publication Data

US 2004/0033872 A1 Feb. 19, 2004

(51) Int. Cl.[7] ..... A63B 26/00

(52) U.S. Cl. ..... 482/142; 482/907; 482/72; 482/100; 482/140

(58) Field of Search ..... 482/140, 142, 482/907, 72, 100, 148; 602/32; 606/242, 243

(56) References Cited

U.S. PATENT DOCUMENTS 5,409,440 A * 4/1995 Yang ..... 482/138
5,792,079 A * 8/1998 Hatfield ..... 601/49
6,468,191 B1 * 10/2002 Cameron ..... 482/140

* cited by examiner

*Primary Examiner*—Nicholas D. Lucchesi
*Assistant Examiner*—L Amerson
(74) *Attorney, Agent, or Firm*—Friedrich Kueffner

(57) ABSTRACT

A multimode exerciser for muscles and muscle-groups stretch exercises has three horizontal platforms disposed along a horizontal rigid frame or bar elevated above ground. One platform near one end of the frame serves as a seat, while another platform near the foot-end services as a foot/ankle rest. An intermediate platform serves also as a foot rest for certain, different, exercises other than those using the foot-end rest.

4 Claims, 1 Drawing Sheet

MULTI-MODE EXERCISER

BACKGROUND OF THE INVENTION

1. Field of the Invention

The present invention relates to an exercise apparatus in general, and in particular to a multi-mode personal exerciser. More particularly still, it relates to an apparatus suitable for stretch exercises for different bodily muscles and muscle groups.

2. Prior Art of the Invention

Prior art apparatii for exercising individual muscle groups are well known. Recently an apparatus for exercising the abdominal muscles of a user enjoyed widespread use. Other devices are known for exercising (primarily strengthening) targeted muscles or muscle groups. Such apparatii are mostly useful for increasing muscle strength and mass of the targeted muscles.

SUMMARY OF THE INVENTION

The benefits of stretching are well known, in fact, it is one of the three essential components of fitness, namely strength, endurance and flexibility. It is also well known that most people are not spending enough time stretching, which results in increased injuries and reduced range of motion. Gyms everywhere provide users with mats so that they may strength on the floor. An objective of the present invention is to allow a user to perform all the basic stretches he/she normally does on the floor, in a comfortable position elevated above the ground. Although there are other machines that are used for stretching, the present exerciser is unique in that its main focus is to promote the proper techniques for stretching. Existing products force the user into positions they normally would not perform, or that may be harmful to them.

A need also exists for a compact unit that will allow gyms to conserve valuable space. Existing products are often large and bulky, limiting their use in to health clubs and the consumer market.

The present invention endeavors to provide a multi-mode exercise apparatus for stretch exercising of several of an individual's muscles and muscle groups.

An exercise according to the present invention comprises:

(a) a rigid horizontal support elevated above ground having a foot-end and an opposite end;

(b) a user support platform near said opposite end;

(c) at least on foot-ankle support platform near said foot-end; and (d) at least one foot support platform intermediate said foot-end and said opposite end.

The exercise apparatus may also comprise:

(e) horizontal foot-rest means disposed above said foot/ankle support platform for stopping foot movement therebeyond.

The exercise apparatus may further comprise:

(f) horizontal handle means disposed above said horizontal foot-rest means for holding onto by a user of said exercise apparatus when performing a predetermined exercise.

Preferably, the exercise apparatus further comprises:

(g) back-support means at said opposite end.

An advantage of the present exercise apparatus is its versatility in spite of structural simplicity. It allows a user to perform various stretching exercises in a comfortable seated position elevated above the ground.

As would be seen from the detailed description to follow, the present exercise apparatus is particularly suitable for stretch exercises of several muscles and muscle groups of users.

Conveniently, the rigid horizontal support is elevated above ground approximately between 30 and 40 cm. Its length, which should be somewhat adjustable to suit the user's height, is between 120 and 180 cm. Of course, it is possible to manufacture different versions for different age/height groups, while still using the same components.

BRIEF DESCRIPTION OF THE DRAWINGS

The preferred embodiment of the invention will now be described in detail in conjunction with the annexed drawings, in which.

DETAILED DESCRIPTION OF THE DRAWINGS

Figure 1:
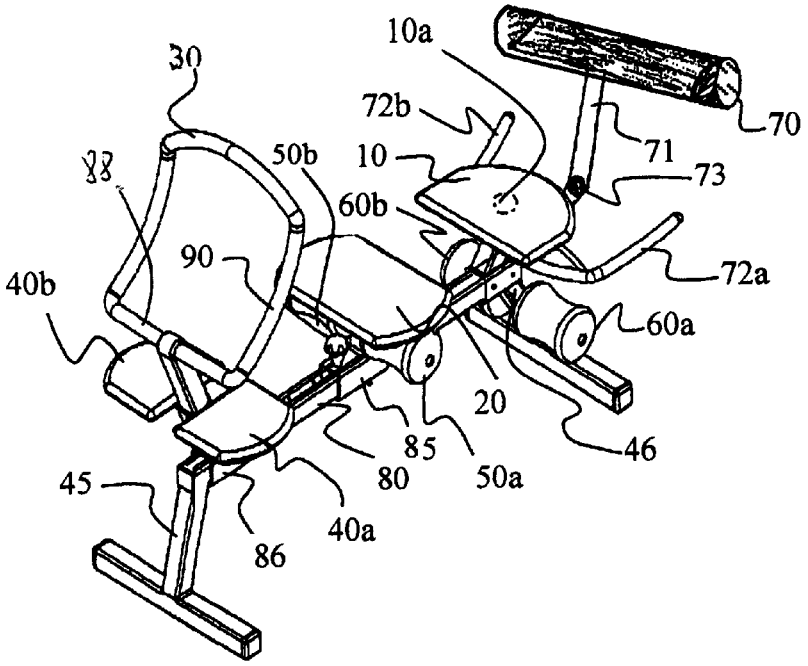
FIG. 1 is a perspective view of the stretch exercise apparatus according to the present invention.
Figure 2:
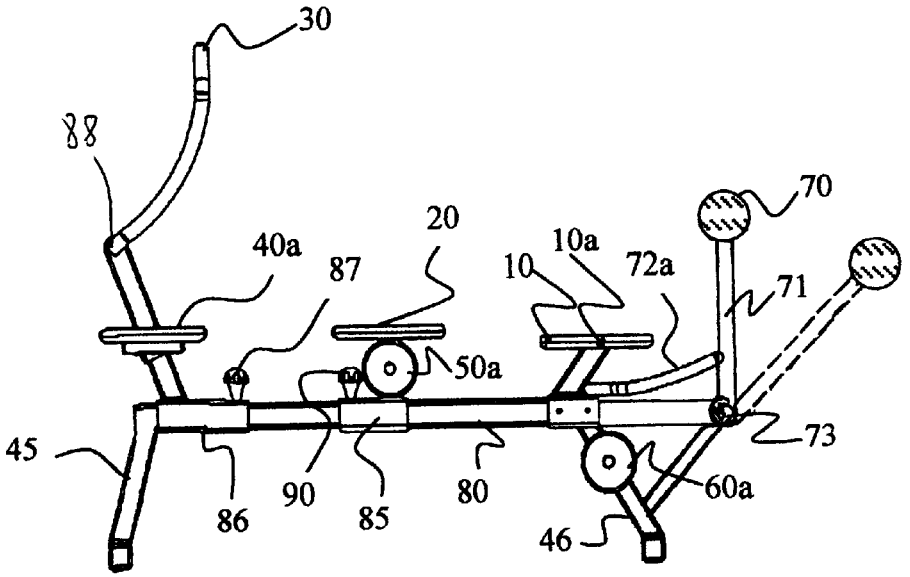
FIG. 2 is a side-elevation of the apparatus shown in FIG. 1.

Referring now the FIGS. 1 and 2, the key components of the preferred exercise apparatus comprise pivoted seat 10 (which swivels around its pivot 10*a* in the horizontal plane by from a few degrees up to 360° ), gripping handle 30 at the foot-end, center foot pad (or pads) 20, foot-end foot pads (or pad) 40*a* and 40*b*, an optional reclineable back-rest 70, gripping handles 72*a* and 72*b* at the head-end, and foam, rubber or the like rollers or cushions 50*a* and 50*b* (under the center foot pad 20) and 60*a* and 60*b* (under supporting frame 80 near the head-end).

The center footpad 20 is attached to a metal slider 85 which travels along a main frame 80. The two smaller foot pads 40*a* and 40*b* are attached to a slider 86 which also travels along the frame 80. A handle 30 is attached to the slider 86. The sliders 85 and 86 are locked into position by pins or tightening mechanisms 90 and 87, respectively. Under the center foot pads 20 are two foam or rubber rollers 50*a* and 50*b*. Also under the seat 10 are two foam or rubber rollers 60*a* and 60*b* that are attached to the leg frame 46. Under the seat 10, and extending behind the seat, are two handles 72*a* and 72*b*. Also behind the seat 10 is foam or rubber roller 70 that is attached to a reclinable metal arm 71 which in turn is hinged at the end of the main body or frame 80. The arm 71 pivots up and down by a hinge mechanism 73.

Further details of the structure and operation of the apparatus will be better understood in conjunction with the following description of the several modes of use to exercise and stretch the identified muscles and muscle groups.

The Groin Stretch—This stretch stretches the groin or inner thigh muscles. The user is seated on the seat 10. Both his/her feet are placed on the center foot pads 20 with the soles of the feet touching each other. The frame 85 is moved closer or further away from the seat depending on the size of the user. The pin 90 is used to lock the center footpads 20 into position. The user holds on to the handle 30 by leaning forward and pulling himself closer to the handle until a stretch on the groin is felt. The user may have to adjust the distance the handle is away from him/her by moving the frame 86 along the body or frame 80 either towards him/her or away from him/her. Again the pin 87 is used to lock the frame 86 into position.

The Straddle Stretch—This stretch stretches the hamstring and quadriceps muscles. The user is seated on the seat

10. One leg is straight so that the ankle rests on one of the smaller foot pads 40*a* or 40*b*. The ball of the foot is pushed against the lower bar of the handle 30. The frame 86 is adjusted away or towards the user will the ball of the foot rests comfortably against the handle 30 when the leg is fully extended. The other leg is bent at the knee and the top of the foot is placed on the roller 60*a* or 60*b* under the seat. The knee or thigh (whichever is more comfortable for the user) of the bent leg is under the center foot pads and rest against the roller (50*a* or 50*b*. When the hamstring of the straight leg is to be stretched the user would hold the handle 30 and pull himself forward. When the quadriceps of the bent leg is to be stretched the user would hold on to the handles 72*a* and 72*b* and lean backwards. The users back would be resting against the roller 70.

The Back Extension—This stretch stretches the abdominal muscles and the chest muscles. The user is seated on the seat 10 with both feet on the floor. The user would lean back on the roller 70. The arm 71 would pivot at the point 70 and the roller would move downward for about 45%. The arm 71 would then lock into place and the user is not able to recline any further. The user would lift his/her arms over his/her and reach backward until he feels the stretch in his/her abdominal muscles and chest muscles.

The Pectoral Stretch—The user is seated on the seat 10 with both feet on the floor. The user would hold the handle 30 with one hand and with the arm extended. He would rotate the seat outward until he feels a stretch of his/her pectoral muscles.

The Lat Stretch: The user is seated on the seat 10 with both feet on the floor. The user would hold the handle 30 with one hand and with the arm extended. He would rotate the seat inward until he feels a stretch of his/her pectoral muscles.

The Individual Leg Groin Stretch—The user is seated on the seat 10 with on leg extended straight and the other on the floor. The foot of the extended leg is on the other side of the base of the handle 30 so that the top of the foot is pressed against the base. The user would rotate the seat away from the body until a stretch in the inner thigh or the groin is felt. The user would hold on to the handles 72*a* and 72*b* to keep his/her balance.

The Glute Stretch—This stretch stretches the glue muscles and the external hip rotators. The user is seated on the seat 10. One leg is extended straight and the ankle rests on the foot pads 40*a* or 40*b*, with the ball of the same foot resting against a horizontal foot-rest portion 88 of the handle 30. The frame 86 is adjusted away or towards the body depending upon the size of the user. The other leg is bent and the knee and crossed over the straight leg the foot resting on the center foot pad 20. The user would hold the knee of the bent leg and move it towards the chest which would stretch the glute muscle. With the other hand the user would hold handle 72*a* or 72*b* and rotate at the hips. This would stretch the hip rotator muscles.

The user, by using a combination of the above positions can develop a large variety of stretching positions. As he/she gains flexibility and body awareness his/her level of sophistication and the degree of difficulty of the stretching positions may be increased at will.

What is claimed is:

1. A multimode exercise apparatus for use by an individual, comprising:

(a) a rigid horizontal support elevated above ground having a foot-end and an opposite end;

(b) a user support platform near said opposite and;

(c) at least one foot/ankle support platform near said foot-end;

(d) at least one foot support platform intermediate said foot-end and said opposite end, and (e) wherein said user support platform is adapted to support said user in a position seated thereon, said support platform further being mounted for swiveling movement in a horizontal plate relative to said rigid horizontal support by up to 360°.

2. The exercise apparatus as defined in claim 1, further comprising:

(f) a horizontal foot-rest member disposed above said foot/ankle support platform for stopping foot movement therebeyond.

3. The exercise apparatus as defined in claim 2, further comprising:

(g) a handle disposed above the foot/ankle support platform for holding onto by a user of said exercise apparatus when performing a predetermined exercise.

4. The exercise apparatus as defined in claim 3, further comprising:

(h) back-support means at said opposite end.

* * * * *